US006238301B1

(12) United States Patent
Takeda

(10) Patent No.: US 6,238,301 B1
(45) Date of Patent: May 29, 2001

(54) GOLF CLUB

(75) Inventor: Hitoshi Takeda, Tsubame (JP)

(73) Assignee: Kabushiki Kaisha Endo Seisakusho, Niigata-ken (JP)

( * ) Notice: Subject to any disclaimer, the term of this patent is extended or adjusted under 35 U.S.C. 154(b) by 0 days.

(21) Appl. No.: 09/515,082

(22) Filed: Feb. 28, 2000

Related U.S. Application Data

(63) Continuation-in-part of application No. 09/102,442, filed on Jun. 22, 1998, now abandoned.

(30) Foreign Application Priority Data

Jun. 26, 1997 (JP) ..... 9-170726

(51) Int. Cl.[7] ..... A63B 53/04

(52) U.S. Cl. ..... 473/324; 473/345; 473/349; 473/350

(58) Field of Search ..... 473/324, 325, 473/326, 327, 328, 329, 330, 331, 332, 333, 334, 335, 336, 337, 338, 339, 340, 341, 342, 343, 344, 345, 346, 347, 348, 349, 350

(56) References Cited

U.S. PATENT DOCUMENTS 3,989,517 * 11/1976 Tanner .
5,255,918 * 10/1993 Anderson .
5,378,295 * 1/1995 Yamashita .
5,465,968 * 11/1995 Aizawa .
5,567,251 * 10/1996 Peker .

FOREIGN PATENT DOCUMENTS

401259876A * 10/1989 (JP) .
407024092A * 1/1995 (JP) .
408243196A * 4/1997 (JP) .
409103522A * 4/1997 (JP) .

* cited by examiner

*Primary Examiner*—Sebastiano Passaniti
(74) *Attorney, Agent, or Firm*—Quarles & Brady LLP

(57) ABSTRACT

A golf club which is so light as to be large-sized, with an improved durability, suited for easy casting. Ti—Be alloy is used for the material of a head 1. Be is present in Ti as a TiBe and/or $TiBe_2$ in a proportion of about 20 mol %. The use of such Ti—Be alloy will result in the lightening of the head 1 as well as the enhanced Young's modulus thereof, thus improving the durability thereof. The Ti—Be alloy has such a lower melting point of 1000 degrees centigrade or below as compared to pure titanium, that the casting thereof is easy.

4 Claims, 11 Drawing Sheets

Ti-Be Phase Diagram

Ti-Be Phase Diagram

Be
Ti
Be12Ti
Be2Ti
BeTi
Be17Ti2
x-ray intensity,arb.unit
10.00
30.00
50.00
70.00
90.00
110.00
2θ /deg Be
Ti
BeOTi
Be2Ti
BeTi
Be17Ti2
x-ray intensity,arb.unit
10.00
30.00
50.00
70.00
90.00
110.00
2θ /deg

GOLF CLUB

CROSS REFERENCE TO RELATED APPLICATIONS

This application is a continuation-in-part application of U.S. Ser. No. 09/102,442 filed on Jun. 22, 1998, now abandoned.

BACKGROUND OF THE INVENTION (a) Field of the Invention

The present invention relates to a golf club, specifically to a material of a head thereof.

(b) Description of Prior Art

In recent years, titanium or titanium alloy has come to be used for a material for a golf head, due to its light and comparatively strong property. Titanium or titanium alloy has been used as a material not only for an iron head or a putter head, but for a hollow metallic head of a wood club (so called metal wood). The light weight of titanium or titanium alloy enables the lightening of a head as well as the large-sizing thereof. A light head is easy to play with, while a large head has a larger sweet area, i.e., an area on a striking face in which a ball travels well and comparatively straight when struck thereon.

Conventional titanium alloy used for a material of a head, for example, is titanium-aluminum (Ti—Al) alloy, as described in Japanese Patent Un-Examined Publication No. 6-545. However, as titanium or titanium alloys have such a high melting point that they have been difficult to cast. For example, the melting point of titanium is about 1,700 degrees centigrade, while that of a Ti—Al alloy also is as high as between 1,500 and 1,600 degrees centigrade. Further, titanium, though it has a high stiffness, is comparatively fragile material, so that it has been liable to be damaged by the shocks developed in striking balls. Furthermore, it has been desired that a golf club head should have an improved strength and be further lightened, in order to be suited for various manners in which it is used.

SUMMARY OF THE INVENTION

Accordingly, it is a main object of the present invention to provide a golf club having an improved durability, realizing a further lightening thereof, using titanium alloy.

It is another object of the invention to provide a golf club which is easy to cast, using titanium alloy.

It is a further object of the invention to provide a golf club whose stiffness, strength and durability is further improved.

To attain the above objects, a golf club of the invention uses Ti—Be alloy for a material of a head, said Ti—Be alloy having a melting point of 1,000 degrees centigrade or below, or at least starting melting at 1,000 degrees centigrade or below. The Ti—Be alloy of such low melting point can be obtained by mixing preferably 20 mol % Be and Ti, and then fusing them. It is desirable to subject the fused mixture to a certain heat treatment and an aging treatment, thereby allowing solid solutions such as TiBe and/or $TiBe_2$ to be precipitated.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which:

FIG. 12(*b*) is another chart showing the X-ray diffraction patterns after the aging treatment in the Ti—10Be alloys of the invention.

FIG. 13(*b*) is another chart showing the X-ray diffraction patterns after the aging treatment in the Ti—20Be alloys of the invention.

DESCRIPTION OF PREFERRED EMBODIMENTS

Hereinafter are described embodiments of the present invention with reference to the attached drawings.

Figure 1:
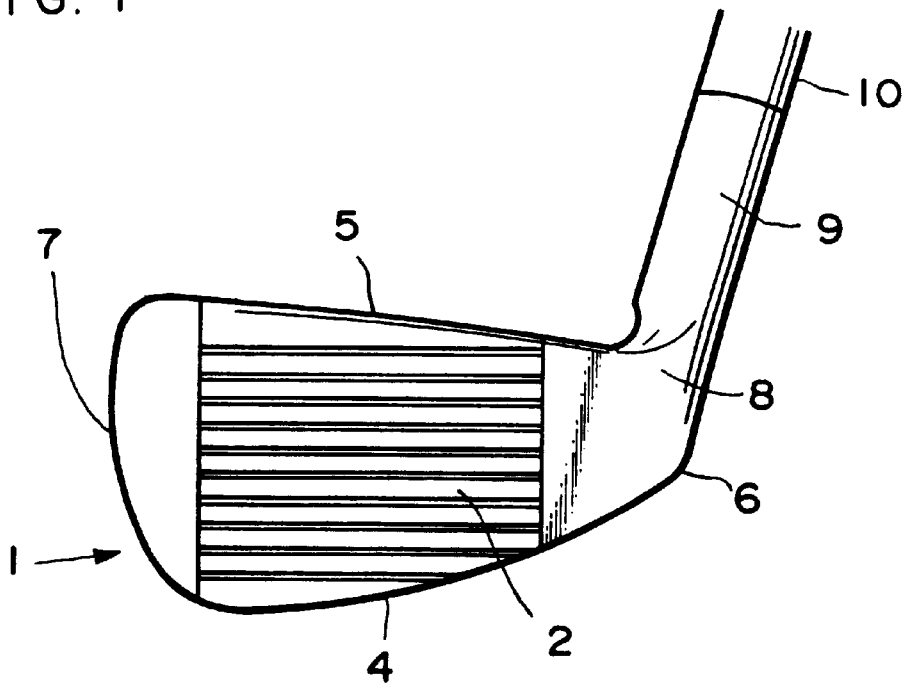
FIG. 1 is a front view showing a first example of a structure of a golf head in accordance with an embodiment of the invention.
Figure 2:
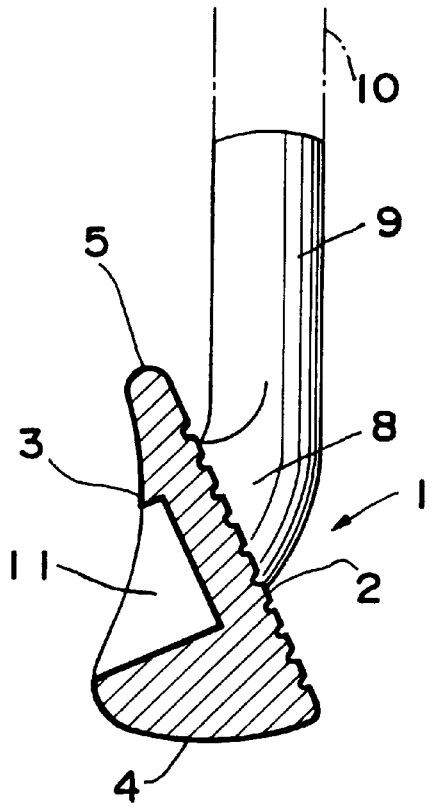
FIG. 2 is a section showing the structure of FIG. 1.
Figure 3:
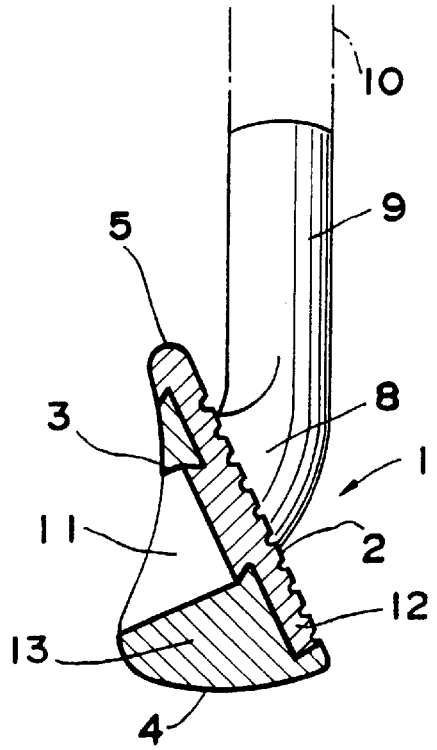
FIG. 3 is a section showing a second example of a structure of a golf head of the invention.
Figure 4:
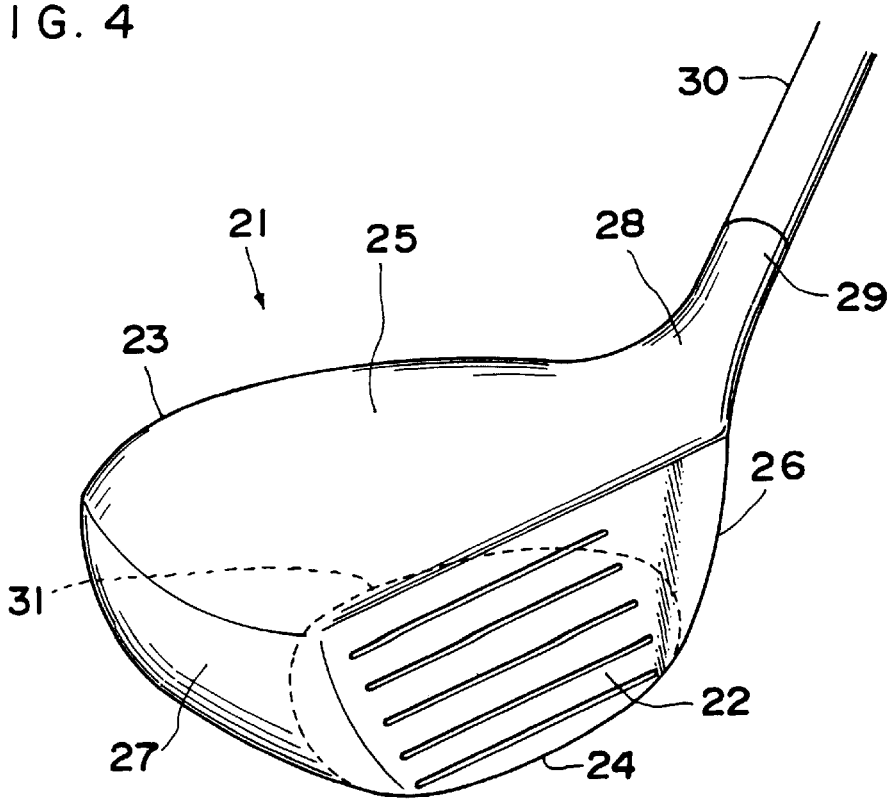
FIG. 4 is a perspective view showing a third example of a structure of a golf head of the invention.
Figure 5:
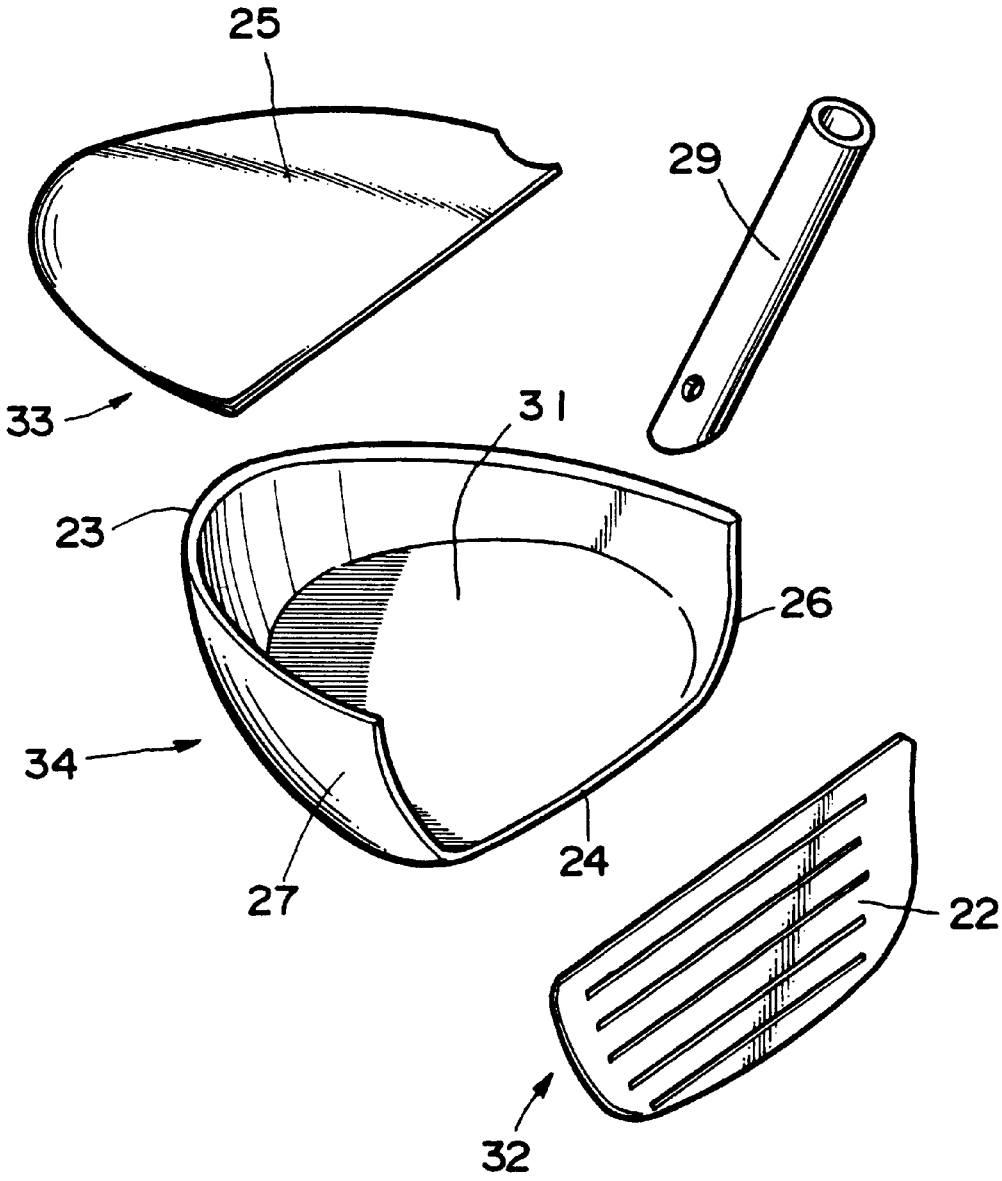
FIG. 5 is an exploded perspective view of the head of FIG. 4.
Figure 6:
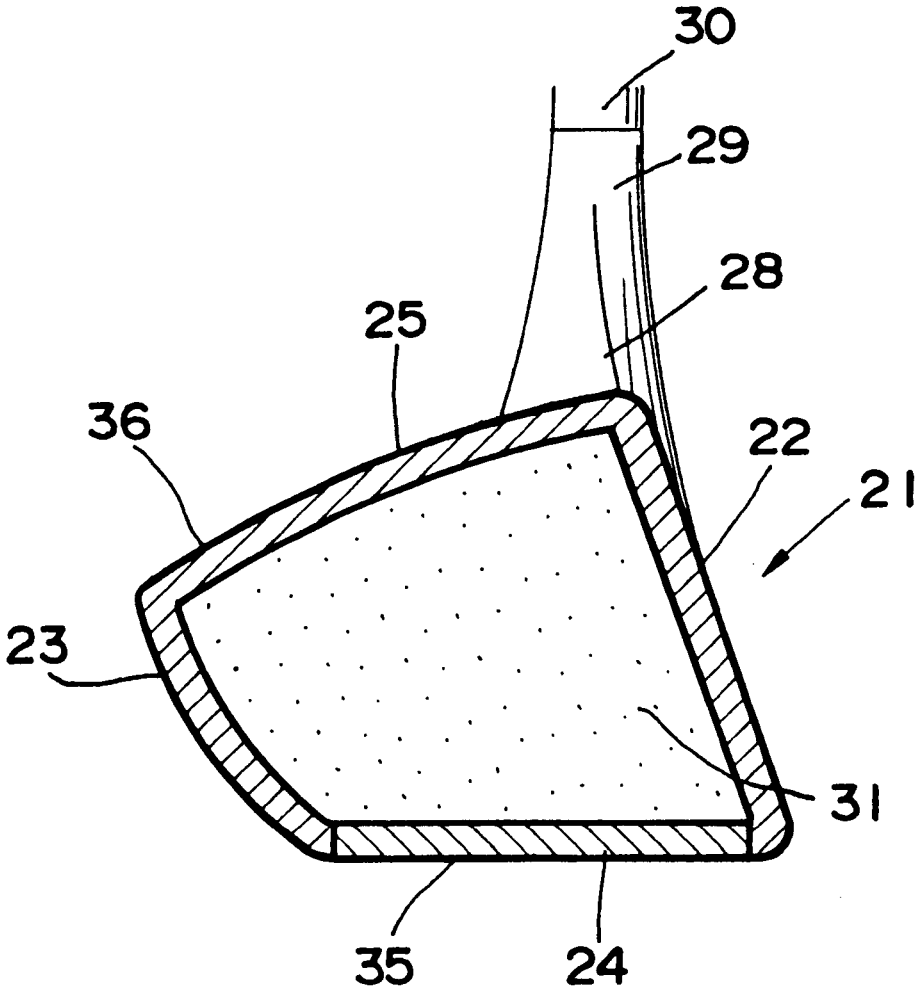
FIG. 6 is a section showing a fourth example of a structure of a golf head of the invention.

Initially, the structures of golf club heads are explained. FIGS. 1 and 2, showing a first example of the structures, relate to a head of an iron club head, and FIG. 3 showing a second example also relates to an iron club head, while FIGS. 4 and 5 showing a third example a wood club head, and FIG. 6 showing a fourth example also a wood club head, respectively.

An iron club head 1 of the first and second examples comprises a striking face 2 on its front surface, a back 3 at its back side, a sole 4 at its lower side, a top 5 at its upper side, a heel 6 at its proximal side and a toe 7 at its distal side respectively. The heel 6 is formed with a neck 8, from which is protruded a hosel 9, extending upward. The hosel 9 serves as a shaft connector for connecting a shaft 10 therewith. The back 3 is formed with a cavity 11 defined by hollowing it except its periphery.

The head 1 of the first example is formed integrally, as a whole, by means of forging, casting or the like. On the other hand, the head 1 of the second example is constructed of two pieces, consisting of a head body 12 having the face 2, the neck 8 and the hosel 9, and a weight 13 secured to the rear side of the head body 12. These head body 12 and weight 13 are each formed by means of forging, casting or the like.

The wood club head 21 of the third and fourth examples comprises a striking face 22 on its front surface, a back 23 at its back side, a sole 24 at its lower side, a top 25 at its upper side, a heel 26 at its proximal side and a toe 27 at its distal side respectively. The heel 26 is formed at its upper end with a neck 28, from which is protruded a hosel 29, extending upward. The hosel 29 serves as a shaft connector for connecting a shaft 30 therewith. The head 21 has a hollow portion 31 thereinside, which is filled with filler such as polyurethane or the like.

Specifically, the head 21 of the third example is constructed of separate members, i.e., a face member 32 mainly defining the face 22, a top member 33 mainly defining the top 25, the aforesaid hosel 29 that is pipe-shaped and a body member 34 defining the remaining parts of the head 21. The face member 32, the top member 33, the hosel 29 and the body member 34 are each formed by means of forging, casting or the like, which are secured to one another by means of welding or the like. On the other hand, the head 21 of the fourth example also is constructed of separate members, i.e., a sole member 35 mainly defining the sole 24 and a body member 36 defining the remaining parts of the head 21. In this example, the sole member 35 is formed by forging, while the body member 36 is formed by casting, which are secured each other by means of welding.

In a preferred form of the invention, Ti—Be (titanium-beryllium) alloy is used for the material of the head 1 of the first example, the head 12 of the second example, the face member 32, top member 33 and body member 34 of the third example, and the sole member 35 and body member 36 of the fourth example, respectively.

As Be is a light element, indicating an extremely high Young's modulus, you can add Be to pure Ti so as to lighten pure titanium and enhance its Young's modulus further. According to the Ti—Be alloy of the present embodiment, its Young's modulus is increased by 20% but its density is decreased by 20% as compared to pure titanium, so that $E/\rho$ (Young's modulus/density) is increased by 50%, with a further advantage of its strength being increased by 70% or above. It is imperative that TiBe or $TiBe_2$, as a solid solution of titanium and beryllium, be included in the Ti—Be alloy of the embodiment. Incidentally, for the material of the weight 13 of the second example, stainless steel or beryllium copper alloy each having he larger specific gravity than Ti—Be alloy is used.

By lighting the heads 1 and 21 this way, you can obtain a golf club which is easier to use. Additionally, as the heads 1 and 21 can be large-sized without increasing their weight, sweet area can be enlarged. In addition, owing to their high strength as well as high Young's modulus, there can be provided a golf club of improved durability, well withstanding the stress, less likely to be damaged by shocks caused by striking balls. These advantages are particularly true of the aforesaid head body 12, the face member 32 and the body member 36 each formed with either the face 2 or 22, so that these head body 12, face member 32 and body member 36 can be made thinner, thus enabling the lightening of a golf club further. Moreover, according to the Ti—Be alloy of the invention, its melting point or melting starting point is lowered to as low as 1,000 degrees centigrade or below, which is much lower than that of pure titanium. Therefore, the cast-molding is very easily performed even by means of casting.

The Ti—Be alloy having the aforesaid melting point and mechanical strength can be obtained by mixing Ti with 5 to 67 mol % Be in order that thus mixed Ti and Be may make up 100 mol % (throughout the specification, the sum of the mol % of Ti and Be always makes up 100 mol %), preferably 10 to 50 mol % Be, more preferably 15 to 35 mol % Be. The present embodiment uses the one mixed with 20 mol % Be.

Figure 7:
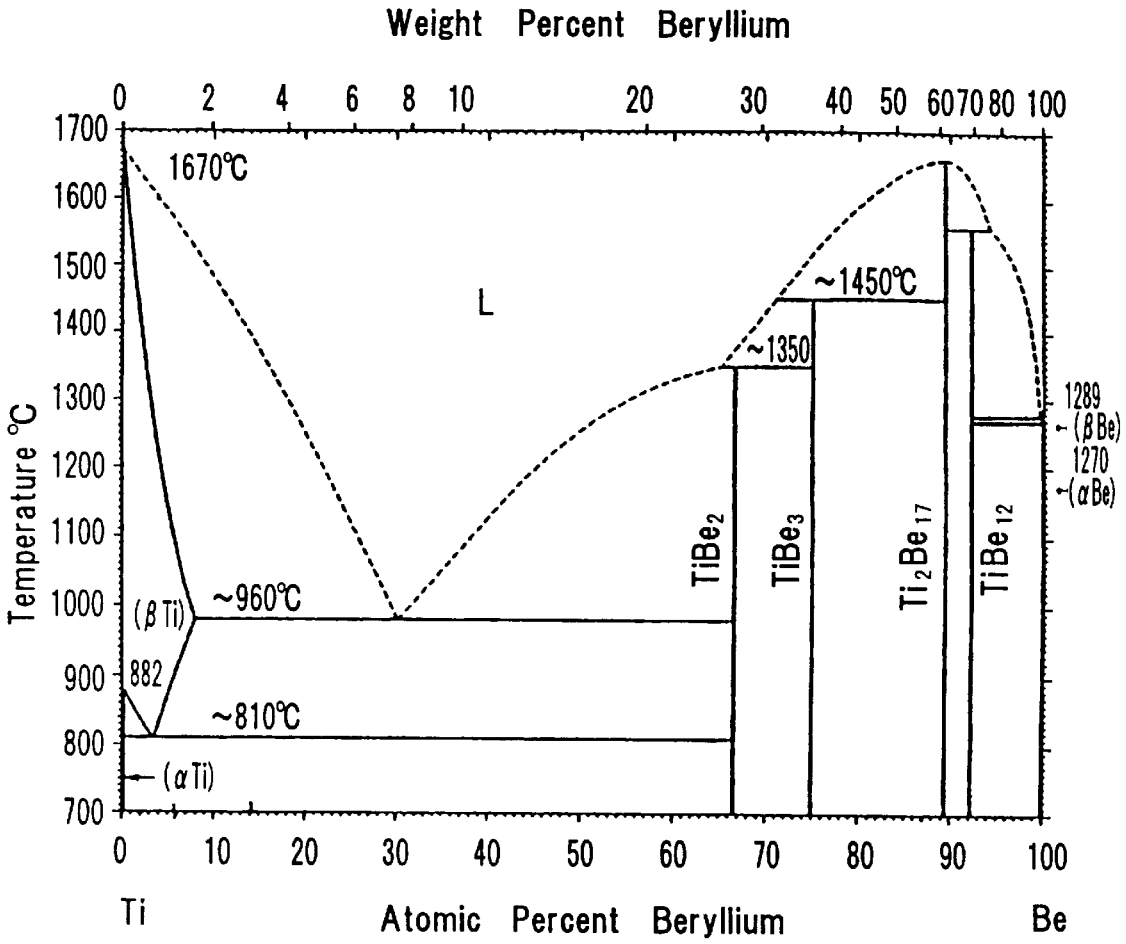
FIG. 7 is a Ti—Be phase diagram showing the phases in respective mixing ratios of Ti to Be.

As shown in FIG. 7 showing a Ti—Be phase diagram, the Ti—Be alloys in the above mixing ratios start to form a liquid phase at 980 degrees centigrade, thereby forming either a liquid-phase or a liquid/solid mixed phase at 1,000 degrees centigrade or less.

The Ti—Be alloy thus mixed can be produced by weighing sponge titanium and metal beryllium to preset weights, respectively, then melting the weighed titanium and beryllium. In a preferred form of the invention, it is further quenched in ices after heat treatment at 1073K for three hours, then quenched again in water after aging treatment for one to ten hours. Specifically, the aging treatment is important, as TiBe or $TiBe_2$ can be effectively produced by the aging treatment, thereby obtaining a material with greater hardness as well as excellent compression characteristic and stress characteristic, which was found particularly true of the one mixed with 20 mol % Be, thereby providing a material suitable for a gold club.

The foregoing is clear from the following experiments. The experiments hereinafter described were performed to measure various properties of the Ti—Be alloy of the invention, in which titanium mixed with 10 mol % Be (Ti—10 mol % Be) and titanium mixed with 20 mol % Be (Ti—20 mol % Be) were melted and then subjected them to the heat treatment under the aforesaid conditions, which were further subjected to the aging treatment for one to ten hours.

Figure 8:
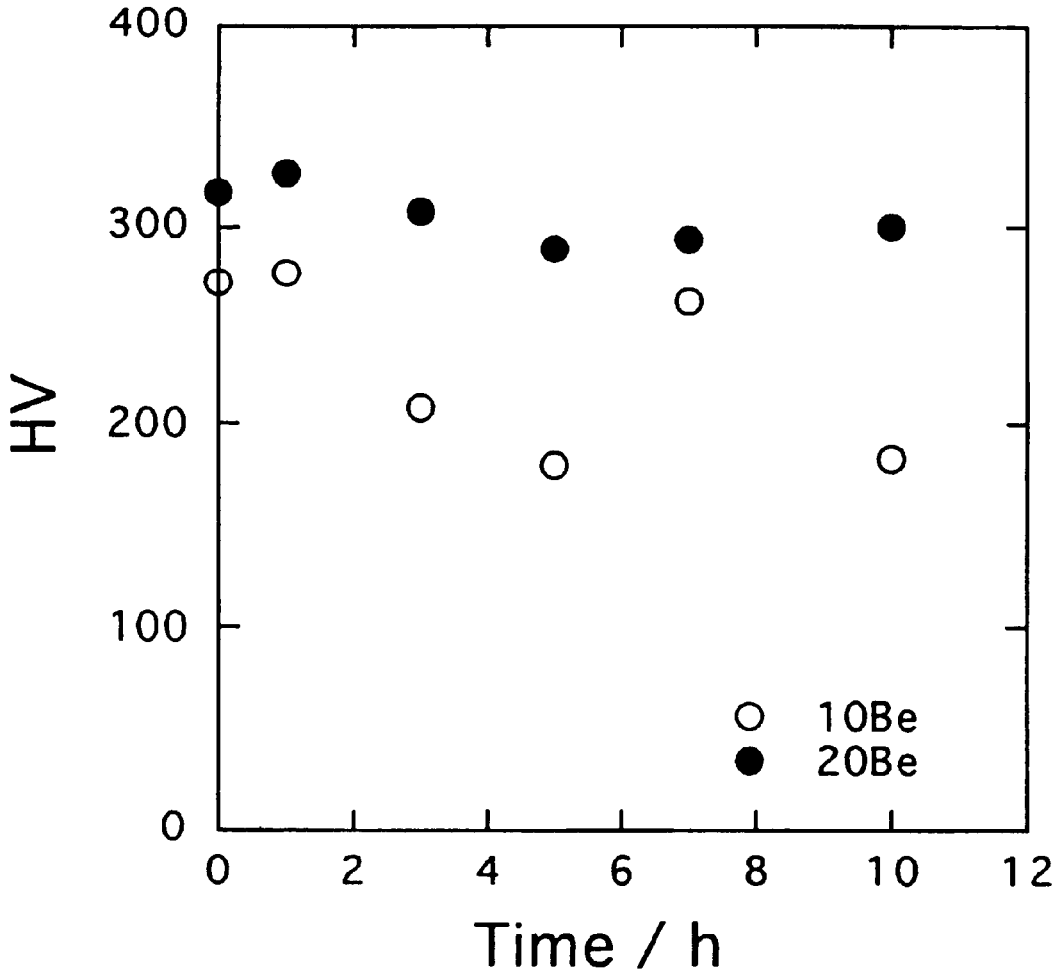
FIG. 8 is a graph showing the relation between the Vickers hardness number and the aging time for Ti—Be alloys of the invention.

In the first experiment, the Vickers hardness SHV) at the respective aging time between one hour and ten hours was measured. As is apparent from FIG. 8 which is a graph showing the relation between them, the Vickers hardness reached the highest value after one hour aging treatment, as compared with the one prior to the aging treatment. Particularly, the graph shows that the hardness became noticeably large for the Ti—20mol % Be alloy, and that the Ti—20 mol % Be alloy has a larger hardness than the Ti—10 mol % Be alloy.

Figure 9:
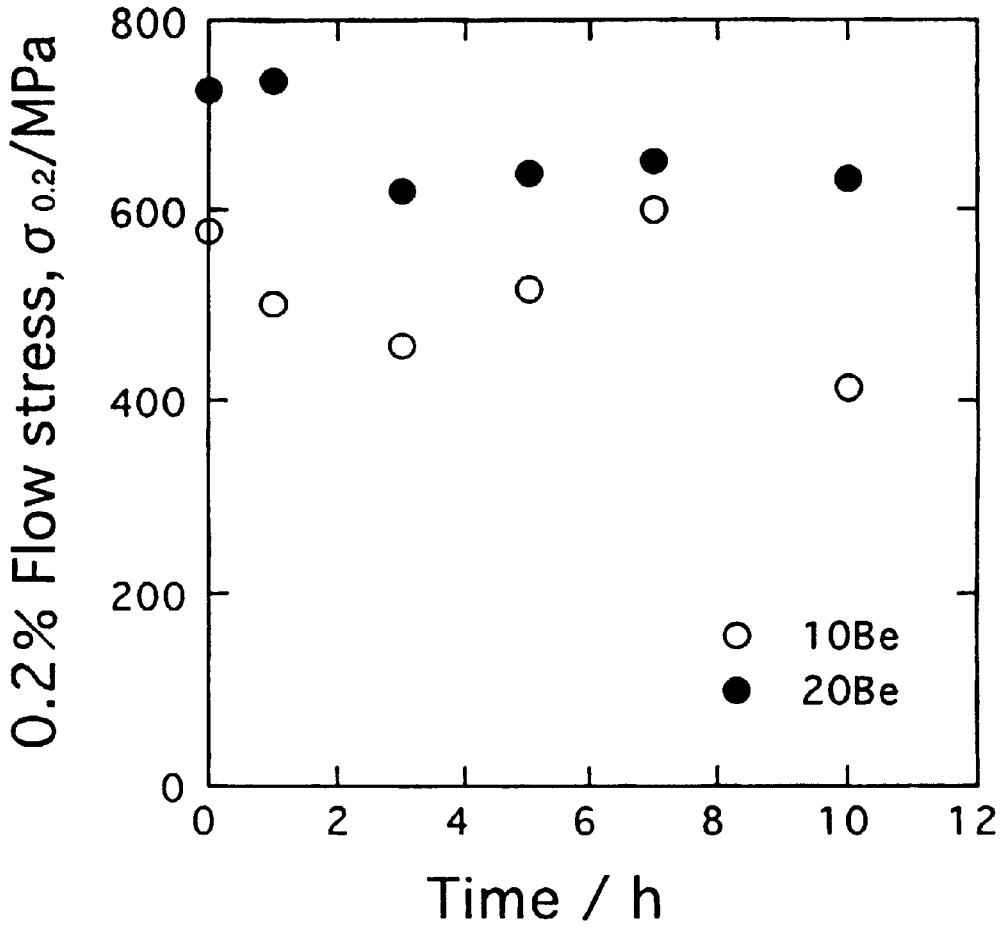
FIG. 9 is a graph showing the relation between the flow stress and the aging time for Ti—Be alloys of the invention.

In the second experiment, the flow stress at the respective aging time between one hour and ten hours was measured. As is apparent from FIG. 9, a graph showing the relation between them, the flow stress indicated a moderate tendency to decrease with the lapse of the aging treatment, as compared with the one prior to the aging treatment. Particularly, the graph shows that the flow stress of the Ti—20 mol % Be alloy was larger than that of the Ti—10 mol % Be alloy.

Figure 10:
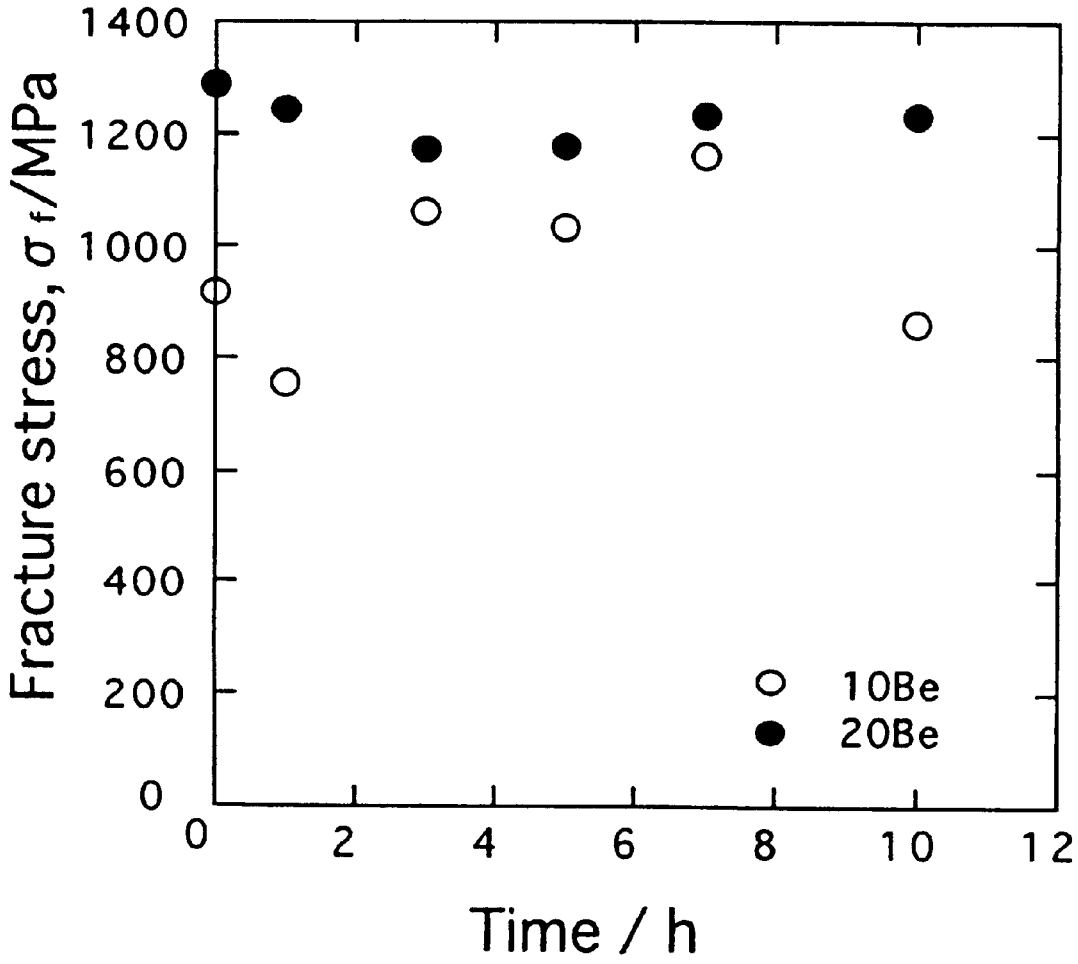
FIG. 10 is a graph showing the relation between the fracture stress and the aging time for Ti—Be alloys of the invention.

In the third experiment, the fracture stress at the respective aging time between one hour and ten hours was measured. As is apparent from FIG. 10, a graph showing the relation between them, the fracture stress tended to be held substantially constant, as compared with the one prior to the aging treatment. Particularly, the graph shows that the fracture stress of the Ti—20 mol % Be alloy was larger than that of the Ti—10 mol % Be alloy.

Figure 11:
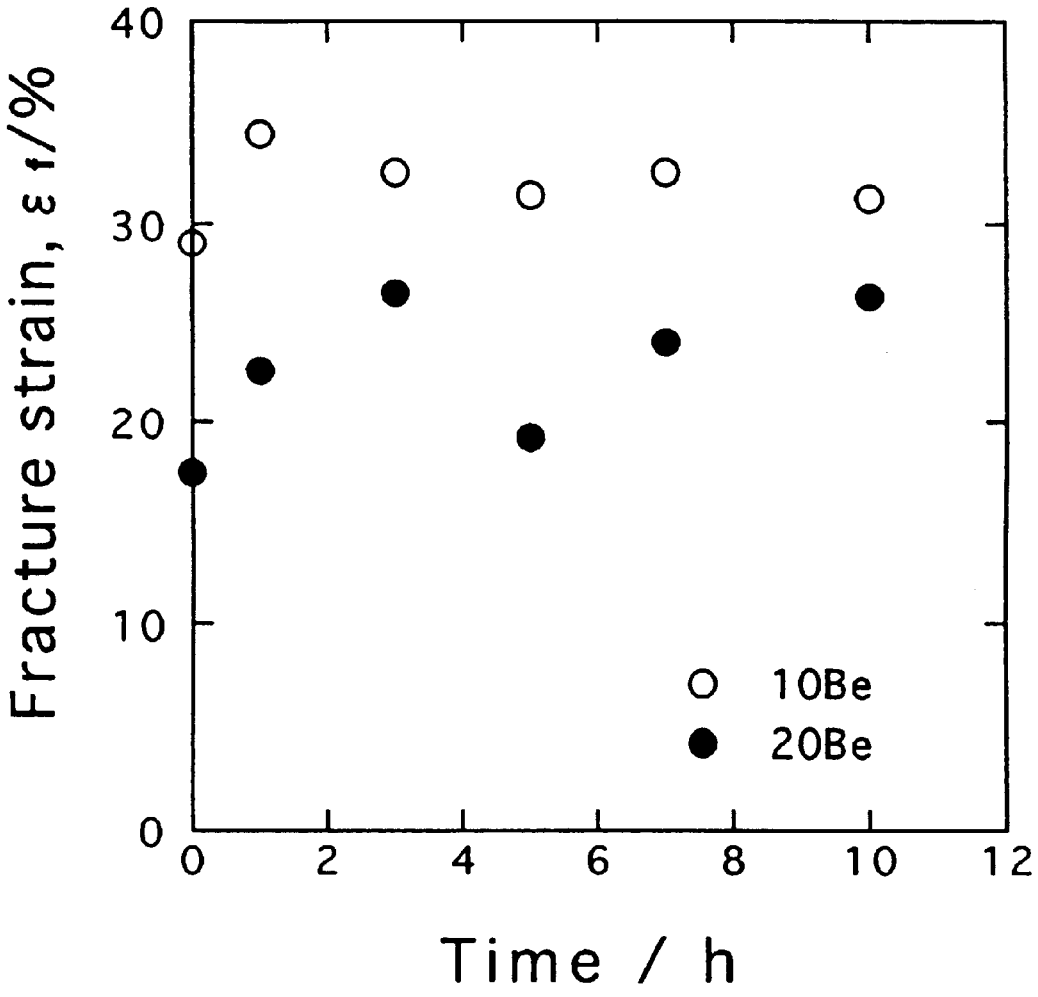
FIG. 11 is a graph showing the relation between the fracture strain and the aging time for Ti—Be alloys of the invention.

Further in the fourth experiment, the fracture strain at the respective aging time between one hour and ten hours was measured. As is apparent from FIG. 11, a graph showing the relation between the strain and the time, the fracture strain also tended to be held substantially constant, as compared with the one prior to the aging treatment. Particularly, the graph shows that the fracture strain of the Ti—20 mol % Be alloy was smaller than that of the Ti—10 mol % Be alloy.

It is clearly demonstrated by these first to fourth experiments that the properties, such as hardness, flow stress, fracture stress and fracture strain of the alloy can be optimized by suitably arranging the aging conditions. Clearly the obtained alloy is considered suitable for a material of a golf club. It was also found that the Ti—20 mol % Be alloy has noticeably excellent properties for a material of a golf club, and that any of these Ti—Be alloys of the invention was melted or started melting at 1,000 degrees centigrade or below.

Figures 12A, 12B:
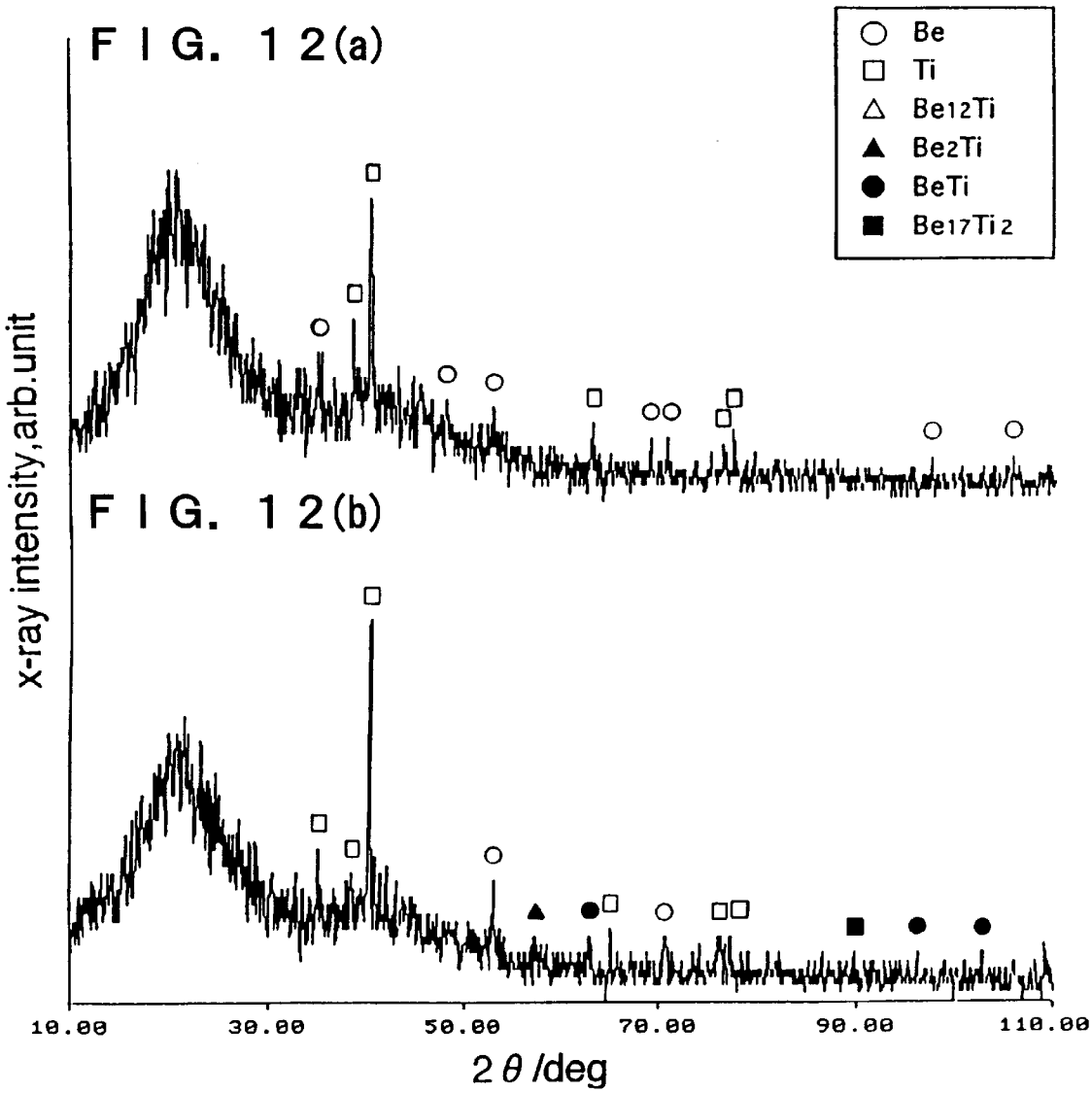
FIG. 12(*a*) is a chart showing the X-ray diffraction patterns before the aging treatment in the Ti—10Be alloys of the invention.

Next, the composition of the Ti—10 mol % Be alloy and Ti—20 mol % Be alloy before and after the 10 hours' aging treatment was analyzed through X-ray diffraction, and then how the compositional ratios of titanium to beryllium affected the improvement of the properties was observed. FIGS. 12(*a*) and 12(*b*) show the result of X-ray diffraction relative to the Ti—10 mol % Be alloy, while FIGS. 13(*a*) and 13(*b*) show the result relative to the Ti—20 mol % Be alloy.

Figures 13A, 13B:
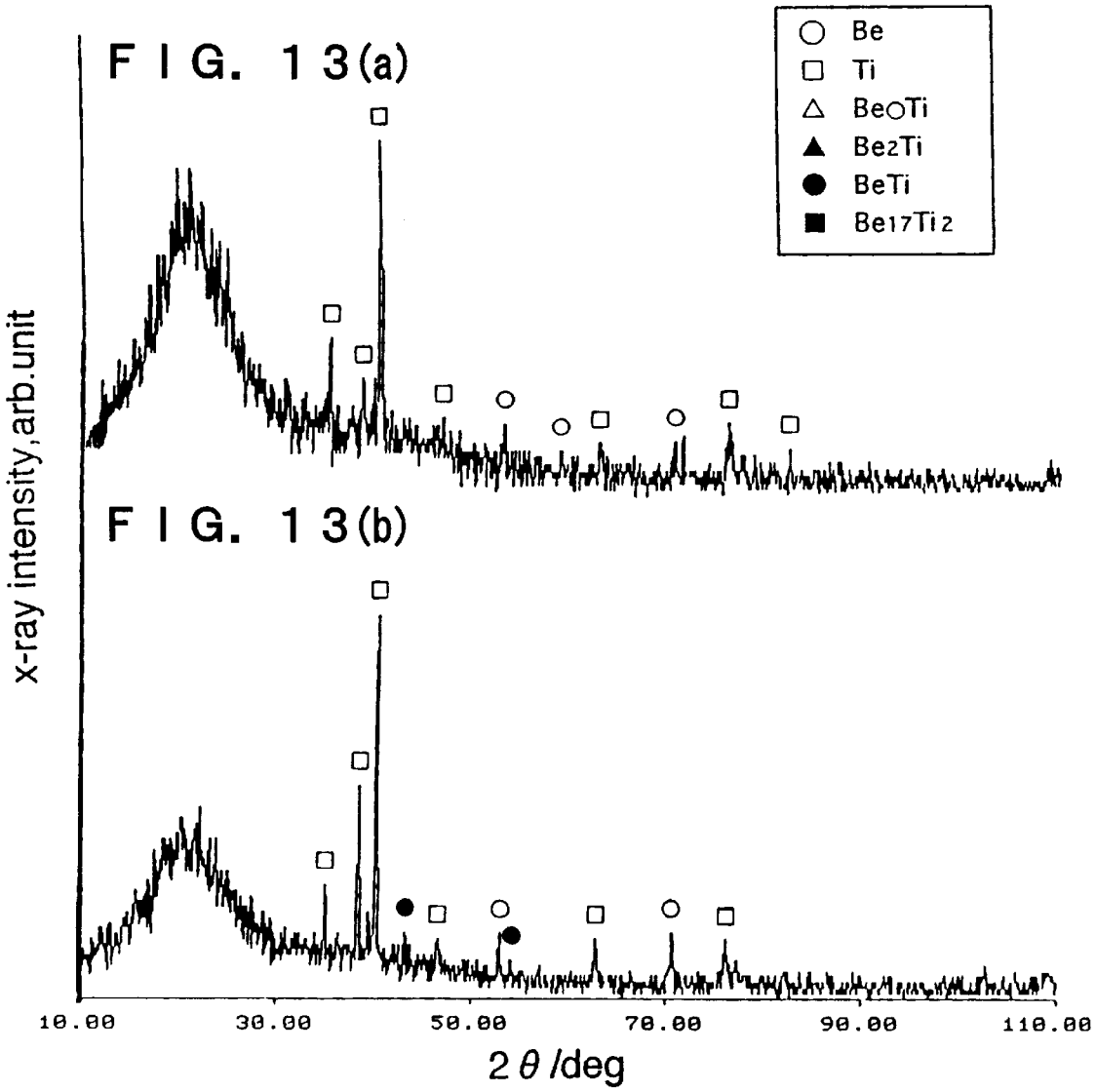
FIG. 13(*a*) is a chart showing the X-ray diffraction patterns before the aging treatment in the Ti—20Be alloys of the invention.

As is apparent from the charts, FIGS. 12(*a*) and 13(*a*) showing the composition thereof before the aging treatment do not show any noticeable peaks showing the presence of TiBe or $TiBe_2$, while FIG. 12(*b*) showing the composition of the Ti—10 mol % Be alloy after the aging treatment does show noticeable peaks showing the presence of TiBe and $TiBe_2$, and FIG. 13(*b*) showing the composition of the Ti—20 mol % Be alloy after the aging treatment also shows noticeable peaks showing the presence of TiBe.

From the foregoing, it is considered that the aging treatment allowed the solid solutions such as TiBe and TiBe2 to be precipitated, thereby having improved the hardness and stress properties of the alloy. Also, it is possibly attributable to the presence of TiBe and $TiBe_2$ that the melting points or melting-starting-points of the Ti—Be alloys have been lowered to 1,000 degrees centigrade or below.

Incidentally, the present invention should not be limited to the foregoing embodiments, but may be modified within the scope of the invention. For example, the present invention may apply to putter golf clubs as well, though the foregoing examples related to iron and wood golf clubs. The structure of heads should not be limited to the above-mentioned examples. For example, the golf club head may be divided in a variety of manners. In that case, the materials specified in the invention may be suitably used for each divided portion. Furthermore, the foregoing temperature and hours of the heat treatment and the aging treatment were disclosed only by way of examples, and thus other temperature and hours may be employed as long as the solid solutions such as TiBe and $TiBe_2$ are present in a titanium alloy and the melting point or melting-starting-point thereof is 1,000 degrees centigrade or below. If these conditions are satisfied, the heat treatment may be omitted.

What is claimed is:

1. A golf club comprising a head which has a face at its front, said head comprising a Ti—Be alloy material selected from a group consisting of materials in which Be is present in Ti in the form of TiBe or $TiBe_2$, and wherein said Ti—Be alloy material starts melting at a temperature as low as about 980–1000 degrees centigrade.

2. A golf club according to claim 1, wherein said face is constructed by a member comprising a Ti—Be alloy material selected from a group consisting of materials in which Be is present in Ti in the form of TiBe or $TiBe_2$, said Ti—Be alloy material starting melting at about 980–1000 degrees centigrade.

3. A golf club according to claim 1, wherein the percentage content of Be in the said Ti—Be alloy is 20 mol %.

4. A golf club head according to claim 1, wherein said Ti—Be alloy essentially consists of Ti base and a solid solution of TiBe or $TiBe_2$ which is allowed to precipitate in the Ti base, through aging treatment of one to ten hours.

* * * * *